US006946042B2

(12) United States Patent
Köhler

(10) Patent No.: US 6,946,042 B2
(45) Date of Patent: Sep. 20, 2005

(54) PYROTECHNIC BODY

(76) Inventor: Josef Köhler, Grub 42, A 4784 Schardenberg (AT)

( * ) Notice: Subject to any disclaimer, the term of this patent is extended or adjusted under 35 U.S.C. 154(b) by 27 days.

(21) Appl. No.: 10/293,414

(22) Filed: Nov. 13, 2002

(65) Prior Publication Data

US 2005/0178484 A1 Aug. 18, 2005

(30) Foreign Application Priority Data

Nov. 14, 2001 (AT) ..... A 1785/2001

(51) Int. Cl.[7] ..... C06B 25/04
(52) U.S. Cl. ..... 149/105
(58) Field of Search ..... 149/105, 45, 46, 149/76, 63

(56) References Cited

U.S. PATENT DOCUMENTS

| | | | | |
|---|---|---|---|---|
| 4,581,082 | A * | 4/1986 | Hagel et al. | 149/105 |
| 5,538,569 | A * | 7/1996 | Carter | 149/105 |
| 2001/0054462 | A1 * | 12/2001 | Hagel et al. | 149/24 |

* cited by examiner

*Primary Examiner*—Aileen Felton
(74) *Attorney, Agent, or Firm*—Collard & Roe, P.C.

(57) ABSTRACT

In order to obtain a pyrotechnic body free of harmful materials, at least one primary explosive from a group of primary explosives is used, this group including atoxic metal cations of a mono- and a dinitrohydroxydiazobenzene ("diazinate"), a ditetrazole compound of highly nitrated organic compounds from salts of the ditetrazole and aromatic nitro bodies having easily replaceable molecular groups and atoxic metal cations of a dinitrobezofuroxane as primary explosives.

12 Claims, No Drawings

PYROTECHNIC BODY

FIELD OF THE INVENTION

Bullet hits are used for staging projectile impacts in theater, television recordings, and film recordings. These are special, low-shrapnel arrangements of small, electrically triggerable detonators, loaded in different strengths, which are loaded with different amounts of primary explosive, sometimes together with secondary explosives as well.

DESCRIPTION OF THE RELATED ART

In this case, according to the related art, two main groups are differentiated, "bullet hits, soft" and "bullet hits, high", the type "bullet hits, soft" being charged with only uncompressed primary explosive or mixtures containing primary explosive and being intended for use on or in the immediate vicinity of people. In principle, the type "bullet hits, high" is a plastic-sheathed, electrically triggerable detonator comprising a small primary charge and a secondary charge (=main charge), which is highly compressed in some types, made of nitropenta or hexogen, for example. This very strong line of products is mainly used in the earth, snow, and water, and in the field of stage building. However, the object of the present invention is predominantly to be the line of "bullet hits, soft". The composition weight (bullet hits, soft) is typically 2 to 384 mg in this case and is given in grains (1 grain=65 mg). These pyrotechnic special detonators have the shape of either a 0.5–2 mm thick disk, whose diameter differs depending on the loading weight, or of a cylinder.

In addition to the typical safety requirements in regard to handling, storage, and transport placed on such pyrotechnic bodies, they are also subject to requirements for very low shrapnel and not too brisant disintegration, as well as a low-smoke detonation without production of flames in case of electrical triggering. According to the related art, neutral lead salts of styphnic acid, i.e., the lead trinitroresorcinate known in detonating agent fabrication, is used as the primary explosive. It is also technically possible to use the lead azide used in the relevant industry, however, this heavy metal azide is much too brisant in unmixed form for such an intended use and has safety problems in regard to production and handling. The detonation reaction of unmixed lead azide also displays too large an explosion flame.

The production of suitable lead trinitroresorcinate requires very great technical knowledge about the precipitation method. Only lead trinitroresorcinate provided in a suitable crystal shape and crystal size provides satisfactory results in this case. In particular, the disk-shaped, largely untamped construction of a film effect igniter requires very careful production and/or a suitable lead trinitroresorcinate, since otherwise, due to the very low intrinsic tamping of the uncompressed composition and the relatively long detonation starting path connected therewith, a large explosion flame, which is undesired for bullet hits, occurs. The formation of flame and smoke is, however, only insufficiently suppressed in all bullet hits available on the market, for example through the addition of compounds with a very high nitrogen content, such as lead azobitetrazolate.

The second main problem in these pyrotechnic bodies is the emission of lead, particularly during use inside closed spaces or during the staging of body impacts directly on people. The currently permissible concentration (TLV) for lead, of 0.1 mg/m$^3$, is easily exceeded multiple times, even in large inside spaces, through the sequential serial triggering of sometimes more than a thousand bullet hits of this type. The objects "shot" are also contaminated with lead ("lead level"), which, considering its toxicity, leads to damage to the environment.

SUMMARY OF THE INVENTION

The object therefore comprises developing a detonating composition which is free of heavy metals (for example, free of mercury, lead, and barium), directly triggerable via an electrical resistance bridge, which has a detonating characteristic as similar as possible to lead trinitroresorcinate, even with minimum intrinsic tamping and in the uncompressed state, but which still detonates with low smoke and without forming flames. The brisance and performance ascribed to lead trinitroresorcinate is necessary so that the new, environmentally-friendly detonating composition may be included in the existing assemblies. The cylindrical assembly of "bullet hits, soft" is additionally used as a pyrotechnic trigger and force element in cable cutters, pelican hooks, glass breakers, and trunnion guns, and must therefore also be usable with a new, environmentally friendly detonating composition without extensive restrictions.

Known primary explosives which are free of heavy metals and sufficiently thermally and chemically storable are the potassium salt of 4,6-dinitrobenzofuroxane, diazodinitrophenol (2-diazo-4,6-dinitrophenol), trinitrotriazidobenzene, tetrazene, 2-picryl-5-nitrotetrazole, and 2-methyl-5-nitrotetrazole.

In principle, i.e., with sufficient tamping, the potassium salt of 4,6-dinitrobenzofuroxane may be used in a detonating composition for bullet hits. However, this compound is not more largely used as a main component because its brisance is unsatisfactory, and because it sometimes forms a large amount of vapor, in particular in an explosion in a damp atmosphere.

Diazodinitrophenol has an unsatisfactory detonation reaction without sufficient intrinsic tamping and in the uncompressed state. Compressed diazodinitrophenol, in contrast, if it detonates, is much too brisant at quantities of more than 40 mg. The same is also true for trinitrotriazidobenzene, which is also relatively costly to produce.

The use of tetrazene as a main substance is also not possible due to its very strong smoke formation. The thermal long-term stability is also no longer sufficient for current storage requirements.

2-picryl-5-nitrotetrazole displays the best results in this series, but is also too brisant in quantities over 100 mg and is poorly mixable with other components and/or its detonation strength is difficult to set reproducibly. The production is also very costly and dangerous in this case, a clean product only able to be obtained in relatively low yield. The same restrictions also apply for 2-methyl-5-nitrotetrazole, the yield being even lower than for 2-picryl-5-nitrotetrazole in this case.

It has now been found that pyrotechnic bodies meeting all requirements for detonating compositions result if they contain at least one primary explosive selected from a first group consisting of non-toxic metal cations of a mono- and a dinitrohydroxydiazobenzene ("diazinate"), and at least one primary explosive selected from a second group consisting of a ditetrazole compound of highly nitrated organic compounds from salts of the ditetrazole and aromatic nitro bodies having easily replaceable molecule groups and non-toxic metal cations of a dinitrobenzofuroxane. By varying the proportions of these primary explosives in their mixture, with the optional use of other primary and/or secondary explosives, also free of heavy metals, and possibly further additives (e.g., oxidation and binding agents), it is surprisingly possible to produce pyrotechnic detonating compositions which allow complete detonation with low smoke and without forming flames at any desired tamping.

In the context of using diazinates, which are known from German Patent 391427 and German Patent 2806599, it must be mentioned for reasons of safety that the potassium salt of the dinitrodihydroxydiazobenzene in particular is not safe to handle and, similarly to lead azide, tends to self-detonate during production. This behavior is particularly observed during mixing of water-soluble potassium salts with a diazinate. Strontium diazinate also shows very high sensitivity to impact and friction in its pure form and therefore may also be poured and processed only with suitable passivators, in this case strontium sulfate. For reasons of industrial availability of the starting materials and simpler synthetic pathways, therefore, the non-toxic metal cations of 4-diazo-2,6-dinitroresorcinol are preferred.

The reaction of ditetrazole and/or its salts with highly nitrated organic compounds having easily replaceable molecule groups is described in German Patent 945 010 and Great Britain Patent 771322. However, dipicryl ditetrazole, which is available easily and in very good yield, is preferred for economic reasons.

The detonating compositions according to the present invention may contain the non-toxic metal cations of 4,6-dinitrobezofuroxane, diazodinitrophenol (2-diazo-4,6-dinitrophenol), 4-diazo-2,6-dinitrophenol, tetrazene, diazodinitrobenzene (styphnic diazide), triazidotrinitrobenzene, 2-picryl-5-nitrotetrazole, 2-methyl-5-nitrotetrazole, and the non-toxic metal cations of 5-nitraminotetrazole, 4-hydroxyamino-5,7-dinitrobenzofurazine-3-oxide, 5,5-diazoaminobitetrazole, 5,5-azotetrazole, azidodinitrophenol, and polynitrophenolates as further primary explosives.

Secondary explosives and oxidation agents which provide a contribution to the reaction are suitable as further components. Those compounds which lead to an oxygen balance which is not too negative and possibly have a high sensitivity to flame are preferably used as secondary explosives. Hexogen, octogen, nitraminoguanidine, hexanitrohexaazaisowurtzitane, tetraethanolammonium pentanitrate, mannitol hexanitrate, 5-nitro-1,2,4-triazole-3-one, 1,3,3-trinitroazetidine, triaminoguanidine nitrate, nitroguanidine, nitrocellulose polyvinynitrate, nitropenta, ammonium dinitramide, and hydrazinum nitroformate may be cited as examples of this. Nitrates, perchlorates, and chlorates of the alkali and alkaline earth elements, ammonium nitrate, ammonium perchlorates, and zinc peroxide or mixtures of these components may be used as oxidation agents.

Further additives are binders, such as a water-soluble, natural or synthetic glue, for example, based on polyvinyl acetate, polyvinyl butyral, nitrocellulose, rubber, nitrated polyarylether, polynitrophenylene, polyvinyl nitrate, polybutadiene, and their derivatives, as well as processing aids such as Aerosil, graphite, talcum, or pigments. These materials may be used either alone or as a mixture.

The production of the detonating bodies according to the present invention, which are low in harmful materials, is performed according to methods known per se, through screening and granulating the dry mixture or through kneading the water-damp mixture. The metering of the damp mass may be performed in this case through painting into the appropriate perforated plates or through extrusion. The following examples are to describe the present invention in more detail without restricting it.

Preparation of a strontium salt of 4-diazo-1,3-dihydroxy-2,6-dinitrobenzene (strontium diazinate):

390 g water-damp (234 g dry weight) 2,6-dinitro-4-diazoresorcinol (diazine) is placed in a beaker, provided with stirrer, thermometer, and glass pH electrode, and filled up with distilled water to a total volume of 1000 ml. 42 g $MgSO_4 7H_2O$ is introduced into the suspension with stirring and the diazine is converted into its water-soluble magnesium salt using approximately 22 g MgO. In this case, a pH value of approximately 6.0–6.5 is to be achieved, exceeding pH 7 having to be avoided here in any case. The deep black solution is filtered via a folded filter into a heatable and coolable precipitate container. A solution of 197 g $Sr(NO_3)_2$ in 420 ml distilled water is dripped in at a temperature of 23–26° C. with stirring over a period of approximately 60 minutes and then stirred for a further 200 minutes at 19–21° C. The precipitated, dark green product is suctioned off and thoroughly rewashed with a total of 200 ml of distilled water in small portions (approximately 50 ml). Approximately 390 g of water-damp strontium diazinate (approximately 297 g of dry substance) is obtained, having a proportion of 10–15% strontium sulfate as a passivator.

Preparation of 2,2-dipicryl-5,5-bistetrazole (dipicryl ditetrazole):

1350 ml acetone is placed in a 2 l three-neck flask, provided with a stirrer and a reflux cooler, and 110 g 1-chloro-2,4,6-trinitrobenzene (picryl chloride) is dissolved therein with stirring at room temperature. Subsequently, 50 g of disodium ditetrazolate pentahydrate or 40.7 g of the crystalline anhydrous salt is introduced into this solution. Subsequently, 150 ml of distilled water is also added all at once and the batch is heated with stirring to 58–60° C. within 30 minutes with the aid of a water bath. The reaction is allowed to run for 2 hours at a weak boil with stirring and then cooled down to room temperature. The resulting precipitate is suctioned off and thoroughly rewashed, first with approximately 200 ml of acetone and then with approximately 1000 ml of distilled water. Approximately 200 g (approximately 100 g dry substance) water-damp, cream-colored to light green dipicryl ditetrazole is obtained.

Preparation of the cesium salt of 4,6-dinitrobenzofuroxane (cesium dinitrobenzofuroxonate):

226.1 g 4,6-dinitrobenzofuroxane is introduced into 2500 ml of distilled water in a beaker, provided with a stirrer, thermometer, and glass pH electrode, and the suspension is heated to 60° C. 89 g of sodium hydrogen carbonate is introduced into the batch with further stirring in such a way that an excess of alkaline medium is avoided. The solution obtained in this way is cooled down to 40° C. and then dripped into a solution of 195 g cesium nitrate in 1500 ml distilled water within 40 minutes. Subsequently, it is cooled to room temperature and stirred for a further 60 minutes. The precipitated salt is suctioned off and thoroughly rewashed with a total of 400 ml distilled water in small portions. Approximately 400 g water-damp cesium dinitrobenzofuroxonate (approximately 320 g dry substance) is obtained in the form of dark red crystals.

1ST EXAMPLE 70 g strontium diazinate (having approximately 10–20% strontium sulfate), 10 g nitropenta having an average grain size of 60 μm, and 20 g nitraminoguanidine having an average grain size of 100 μm were mixed with the addition of approximately 40 ml water and the damp mass was painted into an appropriate perforated plate. After ejection into the associated receiver, it was dried at 60–80° C. as is typical, and the bullet hit was covered, enameled, and dried. In this way, disk-shaped bullet hits of the strengths ¼, ½, 1, and 2 (grain) and also the cylindrical form in the strengths ¼, ½, 1,2,3, and 6 (grain) were produced. With electric triggering, in comparison to a bullet object made of cardboard, all effect detonators display a low-smoke penetration, whose brisance is very similar to lead trinitroresorcinate, without producing fine.

2ND EXAMPLE 70 g strontium diazinate (having approximately 10–20% strontium sulfate), 7 g nitropenta having an average grain size of 60 μm, 23 g octogen (β-HMX having an average grain size of 10 μm), and 1 g Karaja rubber were homogeneously mixed with the addition of approximately 40 ml of water and the damp mass was painted into an appropriate perforated plate. After ejection into the associated receiver, it was dried at 60–80° C. as is typical, and the bullet hit was covered, enameled, and dried. This detonating composition is predominantly suitable for use in disk-shaped bullet hits having a small charge weight and displays an explosion with very little smoke and flame.

3RD EXAMPLE 24 g strontium diazinate (having approximately 10–20% strontium sulfate), 64 g dipicryl ditetrazole, and 12 g of nitraminoguanidine having an average grain size of 100 μm were homogeneously mixed with the addition of approximately 45 ml water and the damp mass was painted into an appropriate perforated plate. After ejection into the associated receiver, it was dried at 60–80° C. as is typical, and the bullet hit was covered, enameled, and dried. This detonating composition is predominantly suitable for use in disk-shaped bullet hits, the explosion strength corresponding to approximately the same quantity of lead trinitroresorcinate having 98% purity.

4TH EXAMPLE 45 g dipicryl ditetrazole, 40 g potassium dinitrobenzofuroxanate, and 15 g mannitol hexanitrate having an average grain size of 100 μm were homogeneously mixed with the addition of approximately 45 ml of water and the damp mass was painted into an appropriate perforated plate. After ejection into the associated receiver, it was dried at 60–80° C. as is typical, and the bullet hit was covered, enameled, and dried. The detonating composition from this example may be used in the disk-shaped and the cylindrical forms and its brisance is very similar to lead trinitroresorcinate. However, a weak cloud of soot arises during the explosion in this example.

5TH EXAMPLE 45 g dipicryl ditetrazole, 20 g potassium dinitrobenzofuroxanate, 8 g mannitol hexanitrate having an average grain size of 100 μm, and 27 g zinc peroxide (active oxygen content: 12.3%) were homogeneously mixed with the addition of approximately 40 ml of water and the damp mass was painted into an appropriate perforated plate. After ejection into the associated receiver, it was dried at 60–80° C. as is typical, and the bullet hit was covered, enameled, and dried. The detonating composition from this example may be used in the disk-shaped and the cylindrical forms and its brisance is somewhat stronger than the mixture described in the 4th example. For this mixture, the explosion again produces very little smoke and flame.

6TH EXAMPLE 55 g strontium diazinate (having approximately 10–20% strontium sulfate), 15 g diazodinitrophenol, 5 g nitropenta having an average grain size of 5 μm, and 25 g zinc peroxide (active oxygen content: 12.3%) were homogeneously mixed with the addition of approximately 40 ml of water and the damp mass was painted into an appropriate perforated plate. After ejection into the associated receiver, it was dried at 60–80° C. as is typical, and the bullet hit was covered, enameled, and dried. This detonating composition is predominantly suitable for use in disk-shaped bullet hits, the brisance and operating performance exceeding the typical lead trinitroresorcinate composition by approximately 25%. Using this mixture, at the same initial performance, the proportion of the detonating compound may be significantly reduced in relation to the lead trinitroresorcinate compound used.

7TH EXAMPLE 50 g dipicryl ditetrazole, 20 g diazodinitrophenol, and 30 g potassium chlorate having an average grain size of 5 μm were homogeneously mixed with the addition of approximately 40 ml of water and the damp mass was painted into an appropriate perforated plate. After ejection into the associated receiver, it was dried at 60–80° C. as is typical, and the bullet hit was covered, enameled, and dried. This composition may be used in the disk-shaped and cylindrical bullet hits, the explosion of this mixture producing relatively little smoke and flame.

8TH EXAMPLE

Of course, it is also possible, on the basis of the compounds described here, to use a multistage construction, i.e., an explosive train. First, in the wet loading method, 96 mg of a mixture of 70% potassium dinitrobenzofuroxonate and 30% potassium chlorate (average grain size 5 μm) is poured into the sleeve of a 2 strength cylindrical bullet hit and then lightly compressed with a stamp. Subsequently, again in the wet loading method, 32 mg of a mixture of 70% dipicryl ditetrazole and 30% zinc peroxide (active oxygen content: 12.3%) is applied to this charge and then dried at 60–80° C. The cylinder having the bridge wire plug is then sealed and/or glued onto the two-stage composition construction dried in this way so that there is a direct contact between a resistance bridge and the composition containing dipicryl. In this example, the bullet hit again displays an explosion having relatively little smoke and flame, and with a brisance which approaches the brisance of lead trinitroresorcinate.

9TH EXAMPLE 99.2 g strontium diazinate, which contains approximately 30% strontium oxalate as a passivator, and 0.8 g of a binding agent based on polyvinyl acetate are homogenized with 25 g water and the damp mass is painted into an appropriate perforated plate. After ejection into the associated receiver, it is dried in a heating cabinet as usual, and the bullet hit is covered, enameled, and dried. This detonating composition is particularly suitable for very small charge weights, i.e., for charge weights under ½ grain.

10TH EXAMPLE 60 g cesium dinitrobenzofuroxonate, 10 g potassium picrate, 10 g diazodinitrophenol, 10 g mannitol hexanitrate having an average grain size of 100 μm, and 10 g potassium perchlorate having an average grain size of 40 μm are homogenized together with 1.0 g of a binding agent based on polyvinyl acetate and 30 g water and the damp mass is painted into an appropriate perforated plate. This detonating composition may be used in disk-shaped and in cylindrical bullet hits, this composition having an blasting efficiency approximately 20% higher than the known lead trinitroresorcinate composition.

What is claimed is:

1. A bullet hit comprising at least one primary explosive selected from a first group consisting of a non-toxic metal cation of a mono- and a dinitrohydroxydiazobenzene ("diazinate"), and a passivator, and at least one primary explosive selected from a second group consisting of a ditetrazole compound of highly nitrated organic compounds of a salt of ditetrazole and aromatic nitro bodies having easily replaceable molecule groups and a non-toxic metal cation of dinitrobenzofuroxane.

2. The bullet hit of claim 1, wherein the primary explosive selected from the first group is strontium diazinate.

3. The bullet hit of claim 1, wherein the primary explosive selected from the second group is a potassium or cesium salt of dinitrobenzofuroxane.

4. The bullet hit of claim 1, further comprising a primary explosive selected from a further group consisting of diazodinitrophenol (2-diazo-4,6-dinitrophenol), 4-diazo-2,6-dinitrophenol ("iso-diazole"), tetrazene, diazodinitrobenzene (styphnic diazide), triazidotrinitrobenzene, 2-picryl-5-nitrotetrazole, 2-methyl-5-nitrotetrazole, and the non-toxic metal cations of a 5-nitraminotetrazole, a 4-hydroxyamino-5,7-dinitrobenzofurazine-3-oxide, a 5,5-diazoaminobitetrazole, a 5,5-azotetrazole, an azidodinitrophenol, and a polynitrophenolate.

5. The bullet hit of claim 1, further comprising at least one secondary explosive and an oxidation agent.

6. The bullet hit of claim 5, wherein the secondary explosive is a compound which has a not too negative oxygen balance and a high sensitivity to flame.

7. The bullet hit of claim 6, wherein the secondary explosive is selected from the group consisting of hexagon (RDX), octogen (HMX), nitraminoguanidine, hexanitrohexaazaisowurtzitane, tetraethanolammonium pentanitrate, mannitol hexanitrate, 5-nitro-1,2,4-triazole-3-one, 1,3,3-trinitroazetidine, triaminoguanidine nitrate, nitroguanidine, nitrocellulose, polyvinynitrate, nitropenta, ammonium dinitramide, and hydrazinum nitroformate.

8. The bullet hit of claim 5, wherein the oxidation agent is selected from the group consisting of nitrates, perchlorates and chlorates of a non-toxic alkali or alkaline earth metal, ammonium nitrate, ammonium perchlorate and zinc peroxide.

9. The bullet hit of claim 1, further comprising a water-soluble binding agent.

10. The bullet hit of claim 9, wherein the water-soluble binding agent is polyvinyl acetate.

11. The bullet hit of claim 1, further comprising a binding agent based on a compound selected from the group consisting of polyvinyl butyral, nitrocellulose, rubber, nitrated polyarylether, polynitrophenylene, polyvinyl nitrate, polybutadiene.

12. The bullet hit of claim 1, further comprising an additive selected from the group consisting of Aerosil, graphite, talcum and a pigment.

* * * * *